United States Patent [19]

Heimlicher

[11] 4,176,833

[45] Dec. 4, 1979

[54] APPARATUS FOR ADJUSTING PRINTING PRESS FOR CHANGES IN PAPER SIZE

[75] Inventor: Paul Heimlicher, Bolligen, Switzerland

[73] Assignee: Maschinenfabrik WIFAG, Bern, Switzerland

[21] Appl. No.: 883,471

[22] Filed: Mar. 6, 1978

[30] Foreign Application Priority Data

Mar. 7, 1977 [SE] Sweden ..... 7702541

[51] Int. Cl.[2] ..... B65H 45/16

[52] U.S. Cl. ..... 270/71

[58] Field of Search ..... 270/70–77

[56] References Cited

U.S. PATENT DOCUMENTS 3,460,823 8/1969 Neal ..... 270/70

FOREIGN PATENT DOCUMENTS 236248 1/1945 Switzerland ..... 270/71

*Primary Examiner*—Edgar S. Burr
*Assistant Examiner*—A. Heinz
*Attorney, Agent, or Firm*—Ostrolenk, Faber, Gerb & Soffen

[57] ABSTRACT

In a printing press adapted to print different size paper, after the imprinting, the paper passes rotatable cutting rollers whose rotative phase position is invariable; the paper next passes a folding knife cylinder and a coaxial gripper cylinder; the gripper cylinder has cam controlled fingers thereon; cams control these fingers; the rotative phase positions of the folding cylinder, the gripping cylinder and the gripper finger control cams are adjustable through respective control gearing for each of them and with respect to the invariable phase position of the cutting rollers; there is a rigid drive connection to the control gearing for each of the phase adjustable parts for jointly readjusting their phase positions for different size paper; individual calibrating adjustments disengageably connect each phase adjustable part from the rigid drive for individual corrections.

10 Claims, 4 Drawing Figures

APPARATUS FOR ADJUSTING PRINTING PRESS FOR CHANGES IN PAPER SIZE

BACKGROUND OF THE INVENTION

This invention relates to a printing press, and particularly to apparatus for adjusting the printing press for accommodating different sizes of paper webs, or the like webs, which are being imprinted. The invention is useful for printing presses which are equipped with printing plate cylinders that are adapted to replaceably support various printing plates. The printing plates are of different sizes for printing different size paper sheets.

Such a printing press is also provided with at least one folder adapted for handling different size sheets being printed and folded. Such printing presses comprise at least one paper sheet cutting means, a folding cylinder, which usually carries a folding knife blade thereon, and a gripper cylinder which is installed coaxially with the folding knife cylinder and which is adjustable in its rotative phase position with respect to the folding knife cylinder.

Printing presses, and particularly rotogravure presses, use printing plate cylinders which replaceably carry different size printing plates. The sizes of these plates and the sizes of the paper which they print are variable during different printing runs. As a result, the folding apparatus associated with these presses must be internally adapted to different sheet sizes. Additionally, the printing units must also be adapted to the folding apparatus, or vice versa, because although the length of the run of the paper web, between the section of the printing press at which the web is printed and the subsequent folding apparatus remains constant, the number of pictures and/or the size of the imprint on the web changes and adjustments for this are required.

In order to minimize the down time between two successive printing runs, presetting programs have been established for such printing presses. At the start of a new printing run, the cutting and inking registers are already preset so precisely that they lie within the target range of an electronic scanner. The scanner corrects the preset registers rapidly for particular size sheets, with minimum loss of time and minimum misprints. Whether it is operated manually or by automatic devices, the presetting program is complicated if a large number of settings prove necessary. The presetting program is correspondingly simplified if the number of settings can be limited to only a few. The invention is based upon the realization that there is only a minimum number of required settings if all settings rely upon an invariable reference point. It is preferred that the point at which the web is cut into sheets be used as the reference point. A different fixed reference point may be selected, such as the first transverse fold, as has previously been the case. In such a case, for example, when a printing press is alternated between four and six engravings, for the same size paper, two different cylinder circumferences are possible. This complicates the presetting program.

Programmed presetting of printing units with respect to each other and of all of the printing units with respect to the folding apparatus is already frequently employed. However, simultaneous presetting of all elements of the folding apparatus has not previously been known.

SUMMARY OF THE INVENTION

It is the primary object of the present invention to provide apparatus for presetting the folding apparatus of the printing press.

It is another object of the invention to preset the folding apparatus using a minimum number, and preferably perhaps one, of operations.

It is a further object of the invention to preset a printing press through the use of a fixed reference point with respect to which the rotational phase positions of the other rotatable elements of the printing press are adjusted.

According to the invention, only the cutting group, including a cutting roller, of the printing press has an invariable drive connection to the machine shaft of the printing press during all adjustments that are made in the printing press to account for changes in the size of the web of paper, or the like. Other parts of the folding apparatus of the printing press are adjustable for different paper web sizes. All of these adjustable parts are combined in at least one adjustment group which can be preadjusted jointly with respect to the invariably positioned cutting group. According to the invention, there is a common phase adjustment drive connection among all of the adjustable elements of the folding apparatus so that they all may be adjusted together. Each adjustable element of the folding apparatus has a respective rotation spindle associated therewith and these are rotatable together for rotating the adjustable elements.

For further calibrations and adjustments, a disengageable clutch enables each phase adjustable element to be individually adjusted by rotation of its spindle, without adjusting the other elements in the single adjustment group. In normal use in adjusting for different size sheets, however, only the common phase adjustment means is operated.

Other objects and features of the invention will become apparent from the following description of a preferred embodiment which is described in conjunction with the accompanying drawings.

BRIEF DESCRIPTION OF THE DRAWINGS

One embodiment of the apparatus of the invention is described in connection with the accompanying drawings, in which.

DESCRIPTION OF THE PREFERRED EMBODIMENT

Figure 1:
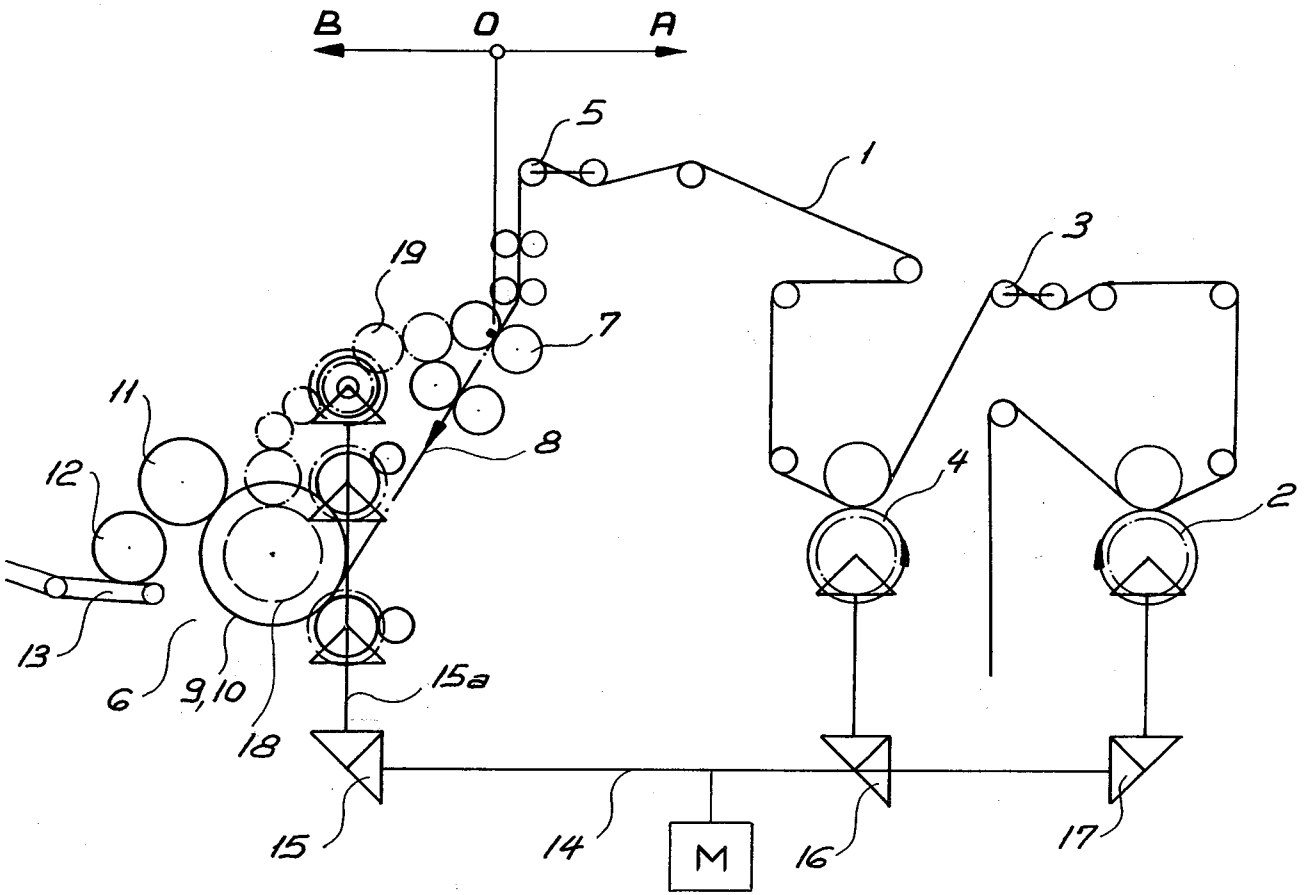
FIG. 1 diagrammatically shows a rotary printing press combined with a variable folder, according to the invention.

Referring to FIG. 1, a web of paper, or the like material, is to be imprinted, cut, folded and delivered. The web is first conducted through a first web printing unit 2. It then passes a register roller 3 and next passes through a second web printing unit 4, for printing the other side of the web, for example. The now printed paper web passes a second register roller 5 and then enters the folding apparatus 6. The place along the web of paper 1 at which the web is cut is adjusted with respect to the imprint on the web.

In the folding apparatus, the web first passes through the cutting group 7 of the folding apparatus. The cutting group 7 contains a known cutting knife roller with means which cut the web into sheets as the knife roller rotates and the web passes by. The sheets of paper which have been cut off are conducted by the endless moving belt 8 to the folding knife cylinder 9. The sheets simultaneously also pass the coaxial, but separately rotatable, gripper cylinder 10. The finished copies now pass the folding knife receiving or gripping cylinder 11 and the shoofly 12 to the sheet delivery 13.

The printing press includes a main machine shaft 14, which is driven by the motor M to rotate. The machine shaft is connected to the printing units 2 and 4 and to other apparatus (not shown) which may operate on the web prior to the cutting and folding of the sheets of the web. The machine shaft 14 is also connected with the various below described units of the folding apparatus by the mechanical connection created by the respective bevel gear pairs 15, 16 and 17 and possibly by other appropriate gearings.

Figure 2:
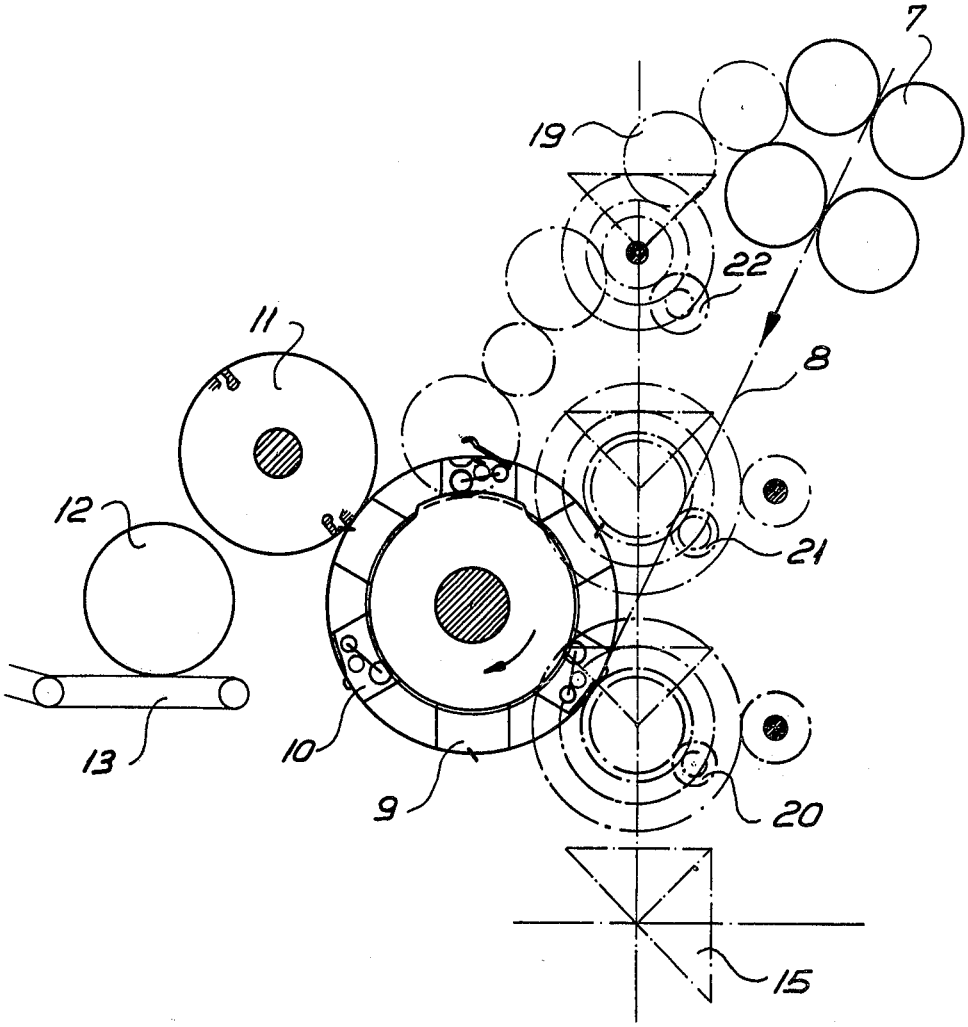
FIG. 2 is an elevational view showing details of the variable folder.
Figure 3:
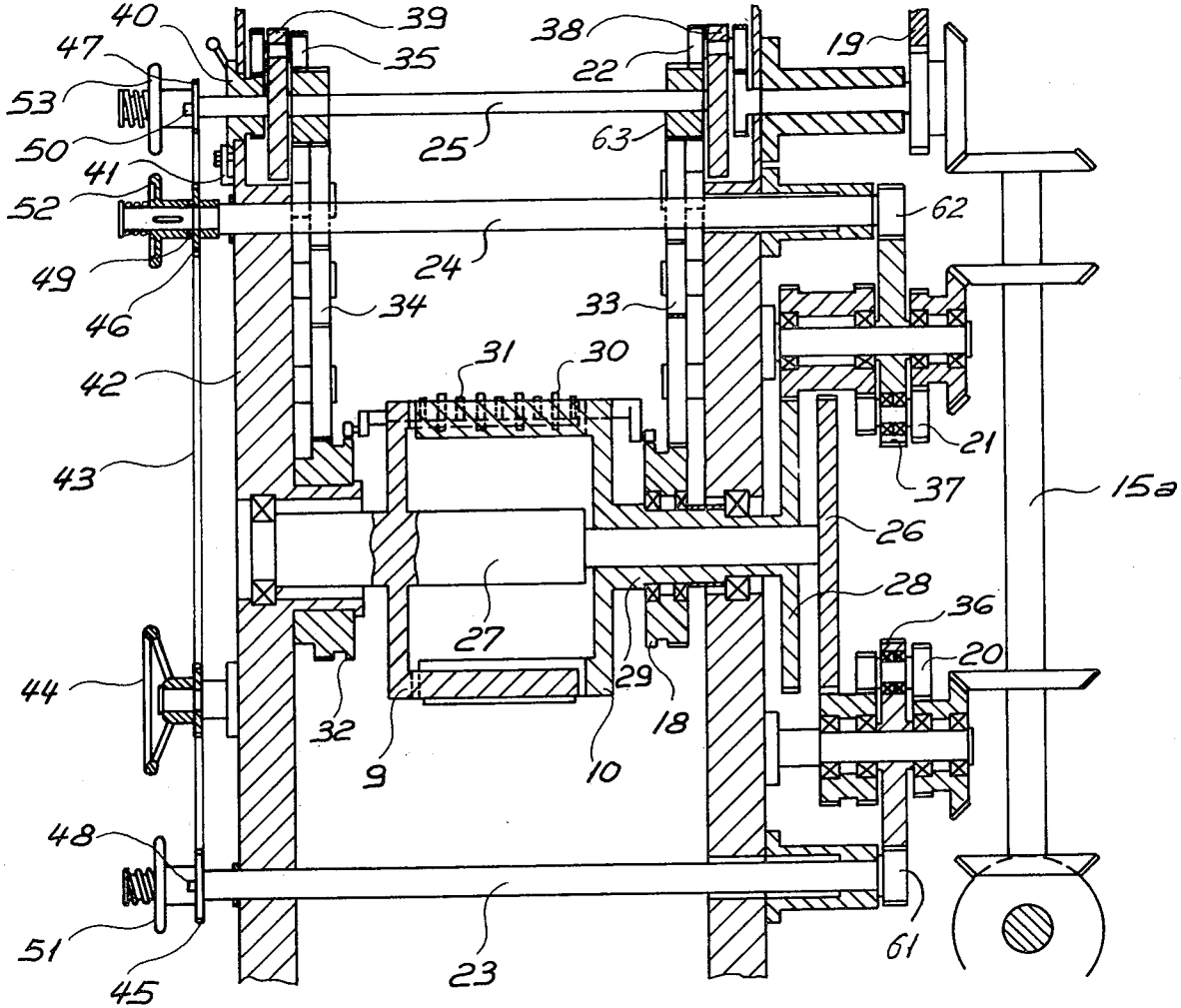
FIG. 3 is a cross-sectional, elevational view through the gripper cylinder and folding cylinder and through the phase adjustment gearings employed in conjunction with the invention.

Referring to FIGS. 1–3, the main bevel gear pair 15 is drivingly connected through the intermediate gearing 15*a* to the folding knife cylinder 9. The intermediate gearing is also drivingly connected to the coaxially mounted and separately movable gripper cylinder 10. The gearing 15*a* is also drivingly connected to the rotatable gripper control cam 18 and to the cutting group 7. These drive connections are, in a known manner, established in an invariable transmission ratio to each other, so that all of the above described connected elements rotate at known relative speeds with respect to each other.

The cutting group 7 is firmly connected with the machine shaft 14 through the gear train 19 for invariable, unadjustable rotation.

Referring to FIG. 3, the folding knife cylinder 9, the gripper cylinder 10 and the gripper control cam 18 are each driven by separate respective phase displacement gearings 20, 21 and 22. As a result, they can be rotated independently of the machine shaft 14 through the below described respective adjustment spindles 23, 24 and 25. The spindles can be adjusted to rotate all of their respective elements during machine operation or during machine down time. Further, through disengageable clutch control means, the individual phase displacement gearings can be rotated by rotation of their respective spindles apart from all of the other elements of the folding apparatus.

The folding knife cylinder 9 is driven for normal operative rotation by the first phase adjustment gearing 20, which is driven to rotate by the intermediate gearing 15*a*. The phase adjustment gearing 20 is in engagement with a first gear 26. The gear 26 is on and causes rotation of the shaft 27. The shaft 27 is supported stationary in the machine frame 42 by rotational bearings which permit rotation of the shaft 27. The shaft 27 supports the folding knife cylinder 9 for rotating the cylinder.

An adjustment spindle 23 is supported for rotation in the machine frame 42. It has a gear 61 at the end thereof, which engages the phase adjustment gear 36 of the gearing 20. Rotation of the spindle 23 through gears 61, 36, adjusts the rotative phase position of the knife cylinder 9. By turning the first adjustment spindle 23, the folding knife cylinder can be rotationally displaced with respect to the gripper cylinder 10 and with respect to the other elements of the folding apparatus.

The gripper cylinder 10 is driven by a second phase displacement gearing 21, which is mechanically connected to and directly driven to rotate by the gearing 15*a*. The gearing 21 is in engagement with a second gear 28. Gear 28 is an extension of the shaft 29 and causes rotation thereof. Shaft 29 is a hollow shaft which is coaxial with and which surrounds and is rotatable with respect to the narrowed end of the shaft 27. Shaft 29 and thereby the associated gripper cylinder 10 are also supported stationary in the machine frame 42 by the bearings which permit rotation of the shaft 29 and the cylinder 10 with respect to the machine frame 42. Shaft 29 adjusts the rotative position of cylinder 10 with respect to the rotated position of cylinder 9.

A second adjustment spindle 24 is supported on the machine frame 42 for rotation, and it has a gear 62 at the end thereof which engages the gear 37 of the gripper cylinder drive and phase adjustment gearing 21. Rotation of spindle 24 adjusts the rotative position of the gripper cylinder 10.

If the folding apparatus 6 is also equipped for collecting, the gripper cylinder 10 includes two types of gripper fingers thereon. There are long gripper fingers 30, which open in a known manner upon each revolution of the cylinder 10 and are controlled by the non-rotating cam 32. There are also short gripper fingers 31 which open at a different rate, for example, once during each alternate or second revolution of the gripper cylinder 10. The gripper fingers 31 are controlled by the gripper cam 18 which is connected to the intermediate drive gearing 15*a* for rotating therewith. The drive connection to the gripper cam 18 from the drive gearing 15*a* is through a gear train 33, which reduces the speed of rotation of the gripper cam 18 with respect to the rotation rate of the gripper cylinder 10. The gear train 33 is connected with the third phase displacement gearing 22. The cam 18 is coaxially mounted around the hollow shaft 29, but rotation bearings on the interior of the cam 18 enable the shaft 29 to freely rotate with respect to the cam, which is rotating at a different speed. Adjustment of the rotative position of the cam 18 with respect to the gripper fingers 32 that it operates is obtained through the gear train 33 which engages a gear 63 on the rotatable third adjustment spindle 25. The bridge gear 38 assures that there is transmission of the rotation of gearing 22 caused by spindle 25 only when that spindle is rotated, and not during the normal rotative caused by gearing 15*a*.

The cam 32 for controlling the long gripper fingers 30 does not rotate during operation of the apparatus. However, the cam 32 is connected by means of a second gear train 34 with a fourth phase adjustment gearing 35. Gearing 35 is also attached on and rotatably displaced by the third adjustment spindle 25, whereby rotation of the spindle 25 simultaneously adjusts the positions of the gripper cam 18 and the second stationary gripper cam 32. The bridge gear 39 of gearing 35 assures that only the rotation of spindle 25 adjusts the phase position of the otherwise stationary cam 32.

The phase adjustment gearings 20, 21, 22 and 35 are, for example, planetary gearings. The respective so-called bridges 36, 37, 38 and 39 for the gearings are all turned only during adjustment of the phase positions of their respective cylinders and cams. These bridges are part of their respective phase adjustment gearings. During the remainder of the operation of the apparatus and, in particular, during rotation of the intermediate gearing 15*a*, the respective bridges 36, 37, 38 and 39 are not rotated.

With reference to the fourth phase adjustment gearing 35, there is a sun gear 40, which is rigidly connected by the strap 41 with the machine frame 42. The gear 40 is rotatable for adjusting the cam 32.

Control over the drive of the cylinders 9 and 10 and of the cams 18 and 32 is affected in two separate ways. First, they are drivingly connected through their respective step up transmissions to the machine shaft 14, 15*a*. This connection operates the cylinders and cams when the phase adjustment gearings and their respective bridges are stationary. The cam 32 is, of course, stationary. Secondly, there is a movement which is superimposed on each of the phase adjustment gearings during the phase adjustment process.

Figure 4:
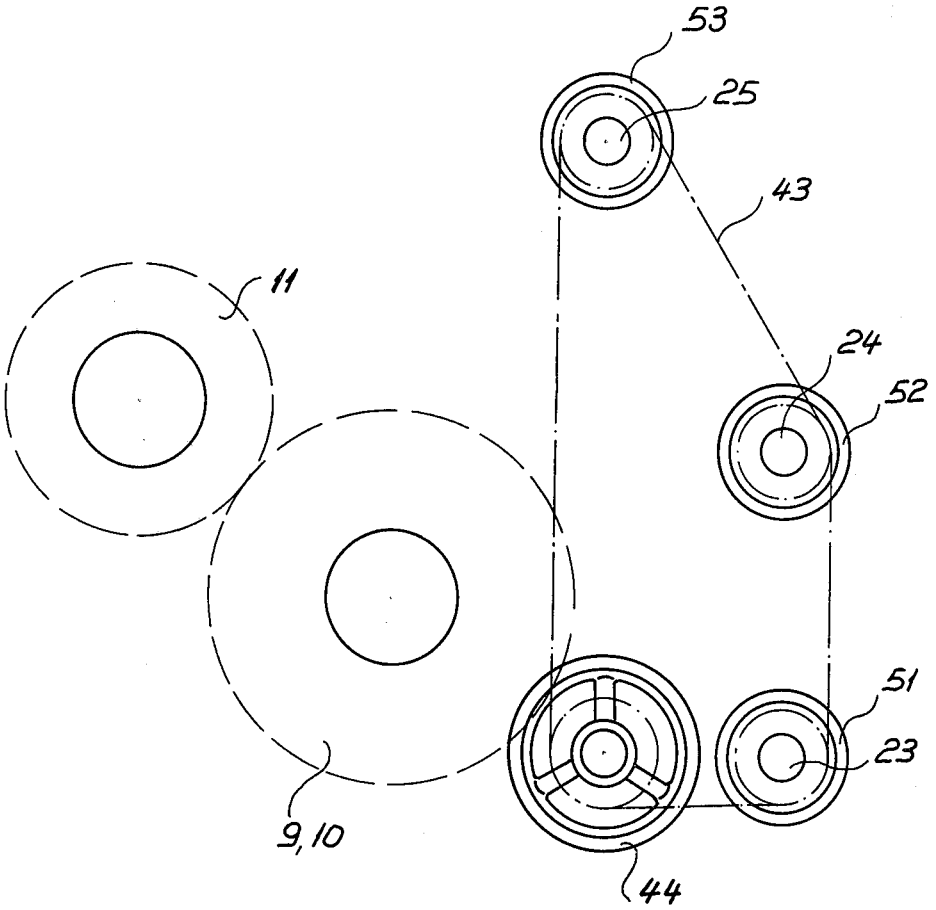
FIG. 4 shows a common phase adjustment device with the various phase adjustment gearings used in the printing press of the present invention.

Referring to FIG. 4, in accordance with a further feature of the invention, the adjustment spindles 23, 24 and 25 are connected together by a rigid drive means, for instance, a chain 43, whereby all are acted upon simultaneously by the common adjustment device 44 which also engages the chain 43. For a particular apparatus, in order that all of the spindles 23, 24 and 25 may rotate the desired amount when the chain 43 is moved, suitable selection of the sizes of the sprocket wheels 45, 46 and 47 assures the desired extents of relative rotation. The sprockets 45, 46 and 47 are respectively connected to their adjustment spindles 23, 24 and 25 by means of the respective disengageable clutches 48, 49 and 50.

Adjustments of the individual sprocket wheels 45, 46 and 47, apart from the other sprocket wheels and their respective spindles, can be individually made by means of the respective connected hand wheels 51, 52 and 53. Such individual corrections might be required, for example, to take account of different thicknesses of the printed product.

Instead of handwheels, and particularly for the common adjustment device 44, servomotors (not shown) may be used so that the individual adjustments may be made remotely from the apparatus and also in order to enable adjustments to be preprogrammed.

Referring to FIG. 1, the invariable or stationary reference point 0 for the apparatus illustrated is the cutting group 7. Adjustments on the printing unit side A and on the folding apparatus side B are effected with respect to the reference point 0.

Although a preferred embodiment of this invention has been described, many variations and modifications will now become apparent to those skilled in the art. It is therefore preferred that the present invention be limited, not by the specific disclosure herein, but only by the appended claims.

I claim:

1. Apparatus for adjusting a folding system for different size sheets of paper, or the like, severed from a web thereof and advancing in a path through the system comprising:

a machine frame;

a rotatable machine shaft for operating various elements of said system;

means for printing the web;

a folding apparatus for different size sheets of paper, or the like, said folding apparatus being located downstream in the path of the web from said means for printing the web; said folding apparatus comprising:

a cutting group, including a cutting roller rotatably supported to said frame; a drive connection to said cutting group from said machine shaft and said drive connection being invariable in its rotational phase with respect to said machine frame;

said folding apparatus further comprising a folding cylinder rotatably supported to said frame and including means for folding a sheet of the web; said folding cylinder being downstream from said cutting group in the path of the sheets of the web of paper, or the like; said folding cylinder being drivingly connected with said machine shaft for being driven to rotate; said folding cylinder being rotatably adjustable in its phase of rotation with respect to said machine frame;

said folding apparatus still further comprising a gripper cylinder for gripping the sheets of the web going past it and being rotatably supported to said frame and being coaxial with said folding cylinder; said gripper cylinder being drivingly connected with said machine shaft for being driven to rotate; said gripper cylinder being rotatably adjustable in its phase of rotation with respect to said folding cylinder around their respective axis;

adjusting means for simultaneously adjusting the phase of rotation of both of said folding cylinder and said gripper cylinder in one operation with respect to the phase of rotation of said cutting roller; said adjusting means being operable for adjusting said cylinders at least while said cylinders are being rotated by said machine shaft.

2. The apparatus for adjusting a folding system of claim 1, further comprising said folding apparatus further comprising said gripper cylinder having gripper fingers thereon;

a gripper finger cam for operating said gripper fingers between different paper gripping positions as said gripper cylinder is rotated; gripper finger cam gearing connected with said gripper finger cam and with said machine shaft for being rotated by said machine shaft and for, in turn, rotating said gripper finger cam; said gripper finger cam gearing rotating said gripper finger cam at a fraction of the rotation speed of said gripper cylinder;

said adjusting means also being for simultaneously adjusting the phase of rotation of said gripper finger cam with respect to said cutting group.

3. The apparatus for adjusting the folding system of claim 2, wherein said folding apparatus further comprises a stationary cam for operating some of said gripper fingers between different respective gripping positions; said gripper finger cam operating others of said gripper fingers between respective different positions; said stationary cam being normally stationary as other parts of said folding apparatus are rotated by said machine shaft;

said adjusting means being connected with said stationary cam for simultaneously adjusting its rotational phase position with said other part of said folding apparatus and for thereafter enabling said stationary cam to remain stationary as said other parts of said folding apparatus are rotated by their connections with said machine shaft.

4. The apparatus for adjusting a folding system of claim 3, further comprising: a respective independent phase adjustment gearing between said machine shaft and said folding cylinder and between said machine shaft and gripper cylinder; said gearing connected between said machine shaft and said gripper finger cam; a respective independent phase adjustment gearing; said gripper finger cam phase adjustment gearing being between said machine shaft and said gripper finger cam and being adapted to rotate said gripper cam at a fraction of the speed of said gripper cylinder.

5. Apparatus for adjusting a folding system of claim 4, further comprising a respective independent phase adjustment gearing between said machine shaft and said stationary cam.

6. The apparatus for adjusting a folding system of claim 5, wherein said means for adjusting all said rotational phase positions and for adjusting them together comprises a rigid drive connection joining all said independent phase adjustment gearings and comprises a common displacement device connected with said drive connection for moving it.

7. The apparatus for adjusting a folding system of claim 2, further comprising: a respective independent phase adjustment gearing between said machine shaft and said folding cylinder and between said machine shaft and gripper cylinder; said gearing connected between said machine shaft and said gripper finger cam; a respective independent phase adjustment gearing; said gripper finger cam phase adjustment gearing being between said machine shaft and said gripper finger cam and being adapted to rotate said gripper cam at a fraction of the speed of said gripper cylinder.

8. The apparatus for adjusting a folding system of claim 7, wherein said means for adjusting all said rotational phase positions and for adjusting them together comprises a rigid drive connection joining all said independent phase adjustment gearings and comprises a common displacement device connected with said drive connection for moving it.

9. The apparatus for adjusting a folding system of claim 8, wherein each respective said independent phase adjustment gearing includes a respective rotatable adjustment spindle supported on said frame and rotatable with respect thereto; means selectively joining each said spindle with its respective said gearing when said spindle is being rotated for adjusting purposes and for disconnecting each said spindle from its said gearing when said spindle is not being rotated, while said machine shaft is operating.

10. The apparatus for adjusting a folding system of claim 9, further comprising a respective disengageable clutch connecting each said spindle with its respective said phase adjustment gearing, whereby when a said clutch is engaged and its said spindle is rotated, the respective said phase adjustment gearing is rotated independently of the other said phase adjustment gearings for obtaining an individual phase adjustment of the respective said gearing.

* * * * *